US005709434A

United States Patent [19]

Chen

[11] Patent Number: 5,709,434

[45] Date of Patent: Jan. 20, 1998

[54] METHOD OF MAKING A BATH SCRUBBER

[76] Inventor: Ching-Chen Chen, No. 1, Lane 147, Sec. 2, Chung San Rd., Yun Lin, Chang Hua Hsien, Taiwan

[21] Appl. No.: 683,436

[22] Filed: Jul. 18, 1996

[51] Int. Cl.[6] ..... B23P 11/02

[52] U.S. Cl. ..... 300/21; 29/446

[58] Field of Search ..... 300/21; 29/446; 15/229.11

[56] References Cited

U.S. PATENT DOCUMENTS 5,144,744 9/1992 Campagnoli ..... 29/446

*Primary Examiner*—Mark Rosenbaum

*Attorney, Agent, or Firm*—Browdy and Neimark

[57] ABSTRACT

A method for making a spherical bath scrubber comprises a tubular network body and two bracing members separated at a predetermined interval for exerting a tensile force on the tubular network body embracing the bracing members. The centers of two stretched sides of the tubular network body are lashed to facilitate the further stretching of two stretched sides of the tubular network body in an alternating and superimposing manner so as to enable the tubular network body to expand from the lashing points to form the spherical bath scrubber.

2 Claims, 1 Drawing Sheet

METHOD OF MAKING A BATH SCRUBBER

FIELD OF THE INVENTION

The present invention relates generally to a bath scrubber, and more particularly to a method for making a bath scrubber.

BACKGROUND OF THE INVENTION

The U.S. Pat. No. 5,144,744 discloses a method for making a bath sponge. The method makes use of a plurality of tubular objects formed of elastic composite netlike articles. Each tubular object is exerted on by the tensile force of a bracing member such that the tensile force is perpendicular to the axis of the tubular object. The tubular objects have a portion which is located between two bracing members and is lashed together with another potions of the tubular objects. Thereafter, each tubular object is drawn out from the top end of the bracing member along the direction of the axis of the tubular object. Upon being relieved of the tensile force, each tubular object forms a spherical object.

Such a prior art method as described above is defective in design in that the density of the periphery of the bath sponge so made is not uniform, and that the quality of the bath sponge so made is compromised.

SUMMARY OF THE INVENTION

It is therefore the primary objective of the present invention to provide a method for making a bath scrubber having the periphery of a uniform density.

In keeping with the principle of the present invention, the foregoing objective of the present invention is attained by an improved method, in which a network body of a tubular construction embraces two bracing members separated at a predetermined interval for exerting a tensile force on the tubular network body. The centers of two stretched sides of the tubular body are lashed. Thereafter, the tubular body is drawn out repeatedly in an alternating and superimposing manner so as to enable the tubular body to expand from the lashing points to form a spherical bath scrubber.

DETAILED DESCRIPTION OF THE INVENTION

Figure 1:
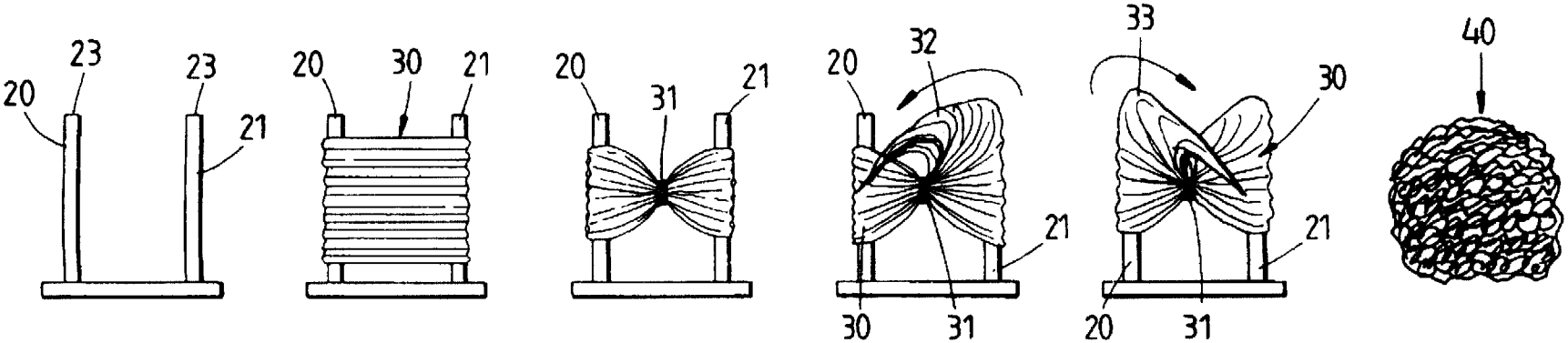
FIG. 1 shows a flow diagram of the method of the present invention.

As illustrated in FIG. 1, the method of the present invention comprises several steps:

First a first bracing member 20 and a second bracing member 21 are arranged such that they are parallel to each other, and are fixed respectively at their bottom ends.

A tubular network body 30 is fitted from top ends of the bracing members 20 and 21 such that the tubular body 30 embraces the bracing members 20 and 21, and the tubular body 30 is stretched by the bracing members 20 and 21.

The centers of the stretched sides of the tubular body 30 are lased by a lashing cord 31.

Further stretching the stretched side 32 of the tubular body 30 is done by pulling the stretched side 32 to pass over the top end of the second bracing member 21 towards the first bracing member 20.

Further stretching the stretched side 33 of the tubular body 30 is done by pulling the stretched side 33 to pass over the top end of the first bracing member 20 towards the second bracing member 21 such that the stretched sides 32 and 33 are superimposed with each other.

Stretching steps are repeated until the tubular body 30 is completely disengaged from the first and the second bracing members 20 and 21 so as to form a bath scrubber 40 of spherical construction.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A method for making a bath scrubber, said method comprising the steps of:

(a) arranging a first bracing member and a second bracing member such that said first bracing member and said second bracing member are parallel to each other and are fixed respectively at a bottom end thereof;

(b) fitting a tubular network body from top ends of said bracing members such that said tubular body embraces said bracing members, and that said tubular body is stretched by said bracing members;

(c) lashing centers of two stretched sides of said tubular body;

(d) stretching further one stretched side of said tubular body by pulling said one stretched side to pass over a top end of said second bracing member towards said first bracing member;

(e) stretching further another stretched side of said tubular body by pulling said another stretched side to pass over a top end of said first bracing member towards said second bracing member such that said another stretched side and said one stretched side are superimposed with each other; and (f) repeating steps (d) and (e) referred to above until said tubular body is completely disengaged with said first bracing member and said second bracing member so as to form a bath scrubber of a spherical construction.

2. The method as defined in claim 1, wherein said one stretched side of said step (d) is kept in a stretching state before said one stretched side is further stretched; wherein said another stretched side of said step (e) is kept in a stretching state before said another stretched side is further stretched; wherein said one stretched side is stretched repeatedly in said step (f) when said another stretched side is kept in a releasing state; and wherein said another stretched side is stretched repeatedly in said step (f) when said one stretched side is kept in a releasing state.

* * * * *